US007438634B2

(12) United States Patent
Habele

(10) Patent No.: US 7,438,634 B2
(45) Date of Patent: Oct. 21, 2008

(54) CLAMPING FIXTURE FOR DETACHABLY FASTENING A DISK-SHAPED TOOL

(75) Inventor: Michael Habele, Waldenbuch (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/622,599

(22) Filed: Jan. 12, 2007

(65) Prior Publication Data

US 2007/0167120 A1 Jul. 19, 2007

(30) Foreign Application Priority Data

Jan. 16, 2006 (DE) ..... 10 2006 001 986

(51) Int. Cl.
*B24B 23/00* (2006.01)

(52) U.S. Cl. ..... 451/359; 451/353

(58) Field of Classification Search ..... 451/352, 451/353, 358, 359, 344
See application file for complete search history.

(56) References Cited

U.S. PATENT DOCUMENTS 3,872,951 A * 3/1975 Hastings, Jr. ..... 188/69
4,467,896 A * 8/1984 Sauerwein et al. ..... 188/69
5,022,188 A * 6/1991 Borst ..... 451/342
5,464,365 A 11/1995 Kirn
6,148,526 A 11/2000 Kirn et al.
7,052,384 B2 * 5/2006 Wolf et al. ..... 451/358
7,128,641 B1 * 10/2006 Lin ..... 451/359

FOREIGN PATENT DOCUMENTS

DE 44 26 969 2/1996
DE 196 49 514 6/1998
EP 0 604 477 7/1994

* cited by examiner

*Primary Examiner*—Dung Van Nguyen
(74) *Attorney, Agent, or Firm*—Michael J. Striker

(57) ABSTRACT

A clamping fixture for detachably fastening a disk-shaped tool on a rotatably driven working spindle with a driven gear includes a fastening element a supporting flange arranged so that the tool is accommodated between the fastening element and the supporting flange and rotatably displaceable relative to the working spindle in the tightening direction and axially in a direction toward the tool. The supporting flange is displaceable relative to the working spindle in a release direction and axially away from the tool when the fastening element is released, and is lockable with the working spindle or a component which is non-rotatably connected with the working spindle in a position which is displaced axially in a direction of the tool, and the supporting flange cannot be displaced axially away from the tool until a lock is released.

9 Claims, 3 Drawing Sheets

CLAMPING FIXTURE FOR DETACHABLY FASTENING A DISK-SHAPED TOOL

CROSS-REFERENCE TO A RELATED APPLICATION

The invention described and claimed hereinbelow is also described in German Patent Application DE 10 2006 001 986.5, filed Jan. 16, 2006. This German Patent Application, whose subject matter is incorporated here by reference, provides the basis for a claim of priority of invention under 35 U.S.C. 119(a)-(d).

BACKGROUND OF THE INVENTION

The present invention relates to a clamping fixture for detachably fastening a disk-shaped tool on a rotatably driven working spindle. Clamping fixtures of this type are suited for use in portable power tools in particular, such as angle grinders, portable circular saws, etc.

Publication DE 196 49 514 A1 makes known a clamping fixture with which a disk-shaped tool is accommodated between a locknut and a supporting flange. When the working spindle is rotated, the supporting flange moves axially in the direction of the tool, which increases the clamping force. The supporting flange is spring-loaded in the direction away from the tool, so that, when the working spindle is not driven, the supporting flange is moved immediately and automatically away from the tool, which, in turn, allows the clamping screw to be loosened easily.

The known clamping device has been proven in practice. The disadvantage of the known clamping device, however, is that the supporting flange is automatically displaced away from the tool when the working spindle stops, without intervention by the operator. The locknut is therefore always easy to loosen when the drive is switched off, which can result in the locknut being loosened accidentally even though the operator intends to continue using the portable power tool.

SUMMARY OF THE INVENTION

It is therefore an object of the present invention to provide a clamping fixture for detachably fastening a disk-shaped 2, which is a further improvement from the existing clamping fixtures.

A clamping device, for portable power tools in particular, via which a disk-shaped tool can be loosened from the working spindle without the use of any aids, but only for the case in which the operator actually intends to loosen the tool.

In keeping with these objects and with others which will become apparent hereinafter, one feature of the present invention resides, briefly stated, a clamping fixture for detachably fastening a disk-shaped tool on a rotatably driven working spindle with a driven gear, the clamping fixture comprising a fastening element; a supporting flange arranged so that the tool is accommodated between said fastening element and said supporting flange, said supporting flange being rotatably displaceable relative to the working spindle in the tightening direction and axially in a direction toward the tool, said supporting flange being displaceable relative to said working spindle in a release direction and axially away from the tool when said fastening element is released, said supporting flange being lockable with an element selected from the group consisting of said working spindle and a component which is non-rotatably connected with said working spindle in a position which is displaced axially in a direction of the tool, and said supporting flange cannot be displaced axially away from the tool until a lock is released.

The present invention is based on the idea of providing a locking mechanism with which the supporting flange can be locked in its clamping position which is displaced axially in the direction toward the tool. The supporting flange must be manually released and the driving action of the working spindle must be halted before the supporting flange can be rotated relative to the working spindle again and, therefore, displaced axially away from the tool, which allows the fastening element to be loosened easily and without the use of any aids. A locknut, in particular, which can be screwed onto an outer thread of the working spindle and rotated opposite to the disk-shaped tool is a potential fastening element.

It is also feasible, however, to provide an outer flange as the fastening means, which is held on the working spindle by the clamping screw. The inventive design of the clamping device prevents the fastening element from being loosened accidentally, since the operator must always intervene intentionally to enable axial displacement of the supporting flange in the direction toward the driven gear. A further advantage of the inventive clamping device is that the tool need not be modified—any common commercial tool can be installed. When the clamping device is located inside the gearbox housing, it is protected from dirt and moisture.

Preferably, the supporting flange is displaceable relative to the working spindle only within a limited angular range at the circumference. This angular range at the circumference is limited by two stops which are separated from each other in the circumferential direction. The stop located in the driven direction serves to absorb a drive torque from a driving element which is non-rotatably coupled with the working spindle. The driving element is preferably connected on the end face of the driven gear which is non-rotatably connected with the working spindle. The driving element and the stop are preferably located relative to each other such that torque is not transmitted by the driven gear to the supporting flange until the maximum axial deflection of the supporting flange is reached.

To loosen the supporting flange without the use of aids, it must first be released. To do this, the supporting flange must first be locked when it reaches a specified axial position, preferably a position with the maximum axial deflection. To increase the operating comfort of the clamping device, the present invention provides that the locking mechanism of the supporting flange can be actuated automatically. This can prevent the clamping device from being operated improperly.

As a possible embodiment of the locking mechanism, a spring-loaded locating bolt is provided as the locking mechanism, which engages in an opening of the driven gear or the working spindle for the purposes of locking. To unlock, the locating bolt must be moved out of the opening and against the spring force. Due to the fact that a spring is provided, the locating bolt locks the supporting flange automatically as soon as the locating bolt is aligned with the opening.

To ensure optimal locking, it is advantageous to provide several spring-loaded locating bolts which are located in the circumferential direction and are separated from each other. They are preferably positioned symmetrically and can be actuated using a central push button.

According to an alternative embodiment of the clamping device, the locking mechanism is designed as a tooth system on the end face between the supporting flange and the driven gear. The engagement can be released in that an actuating element extends through the driven gear and lifts the flange—which is spring-loaded, in particular—out of the engagement. Once the locking mechanism is released, the supporting flange can be rotated and, therefore, moved axially in the direction toward the driven gear. With the design of the clamping device which includes a tooth system on the end face, no additional components are required.

According to a preferred embodiment of the clamping device, the locking mechanism can be released by actuating a spindle locking device. This means the locking mechanism is released automatically when the working spindle or the driven gear are locked. It is feasible, e.g., for the spindle locking device to include a snap-in bolt which can be slid axially into an opening of the driven gear located on the end face, which prevents the driven gear from rotating. The locating bolt for the locking mechanism is accommodated in the same opening. When the snap-in bolt is slid into the spindle locking device, the locating bolt of the locking mechanism is slid axially out of the opening, thereby releasing the supporting flange.

To preload the tool, the spindle lock must be actuated so that torque can be applied. As a result, however, only the driven gear and the working spindle are fixed in position in the direction of rotation. The supporting flange can be rotated again until it reaches a stop, and the fixation can simultaneously snap into place, since the opening in the driven gear is aligned with the locating bolt.

To realize the axial displaceability of the supporting flange, a refinement of the present invention provides that an axial bevel—a helical bevel, in particular—is provided on the supporting flange or the driven gear, against which a rolling element bears. The supporting flange and driven gear can also support each other via two axial bevels which are also preferably designed as helical bevels. By providing at least one axial bevel, the supporting flange is displaced in the axial direction by rotating the supporting flange relative to the working spindle.

To automatically release the tool after the supporting flange has been unlocked, an embodiment of the present invention provides that the bevels are sloped such that self-locking never occurs. This is ensured by the fact that the lead angle of the bevels is greater than the friction angle between the supporting flange and the driven gear.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
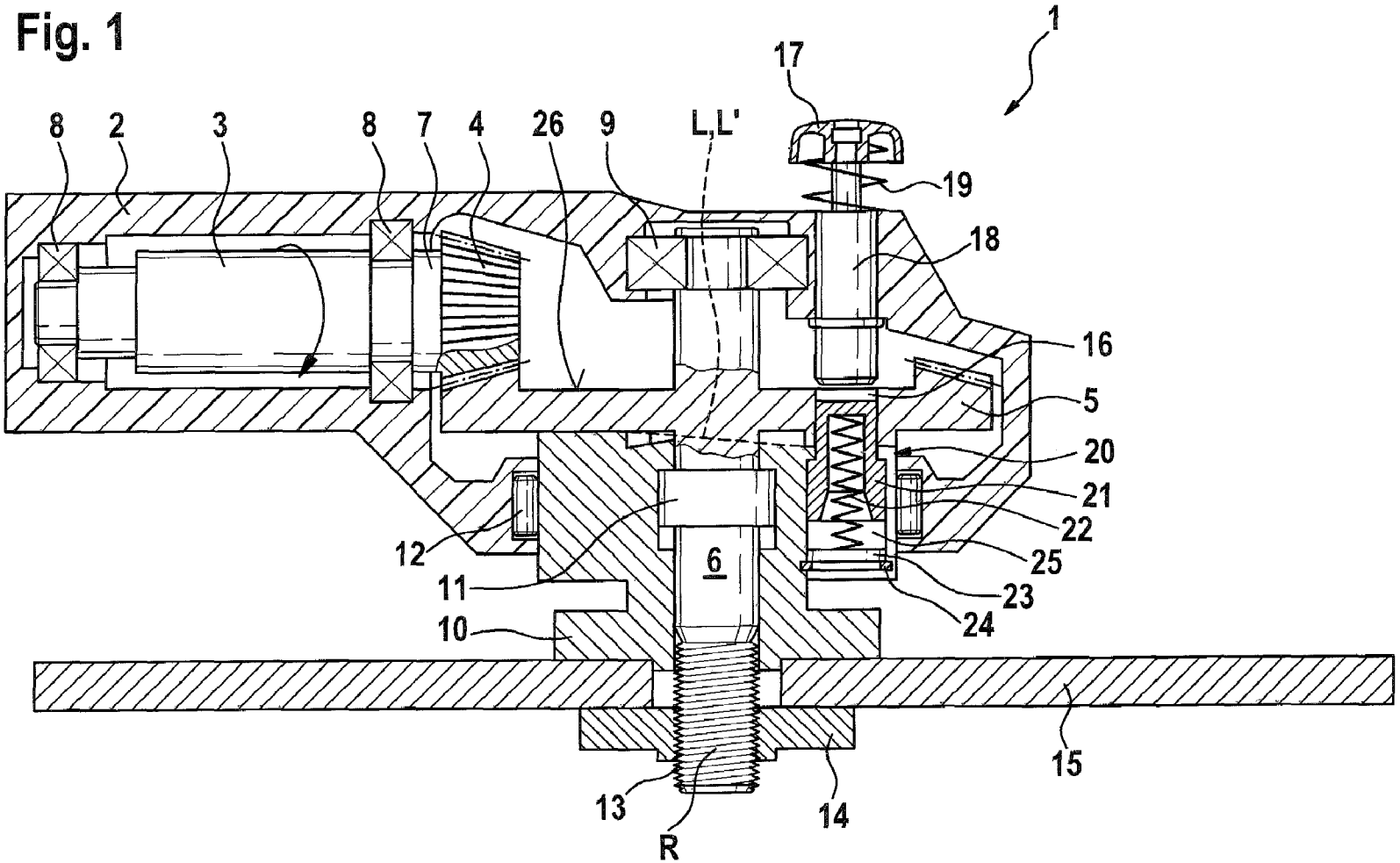
FIG. 1 is a sectional view of an angle grinder with an inventive clamping device.

Identical components and components with identical functionality are labeled with the same reference numerals in the Figures.

Shown in FIG. 1 is a portable power tool 1 with a housing 2, an electric motor-driven drive 3, a drive pinion 4 driven by drive 3, a driven gear 5 which meshes with drive pinion 4 and is designed as a crown wheel, and a working spindle 6 which is non-rotatably coupled with driven gear 5.

Drive pinion 4 is mounted on a motor shaft 7 which is rotatably supported via two separated bearings 8. Working spindle 6 is supported by a spindle bearing 9 such that it is rotatable and axially non-displaceable relative to housing 2. Working spindle 6 is rotatably supported via a further spindle bearing 11 such that it is rotatable relative to a supporting flange 10. A supporting flange bearing 12 is provided to rotatably support supporting flange 10 relative to housing 2. This allows supporting flange 10 to be displaced axially.

A disk-shaped tool 15—a cutting disk in this case—is accommodated axially between supporting flange 10 and a locknut 14 which can be screwed onto a working spindle thread 13. The tool can be clamped between supporting flange 10 and locknut 14 by rotating locknut 14 in the direction toward the tool 15.

A continuous opening 16 in the axial direction is provided inside driven gear 5. A snap-in bolt 18 can be displaced axially into opening 16 against the force of a spring 19 by actuating a push button 17 on housing 2. As a result, driven gear 5 and, therefore, working spindle 6, can be locked in position, non-rotatably, when drive 3 is at a standstill, to prevent working spindle 6 from rotating when tool 15 is installed or removed. The assembly composed of push button 17, snap-in bolt 18, spring 19, and opening 16 is a spindle locking device ("spindle lock").

A locking mechanism 20 is provided inside housing 2 on supporting flange 10, by way of which supporting flange 10 can be non-rotatably locked with driven gear 5. Locking mechanism 20 includes a locating bolt 21 which can be displaced axially in the direction toward driven gear 5 and can engage in opening 16. Locating bolt 21 and snap-in bolt 18 of the spindle locking device therefore alternately make use of the same opening 16. Locating bolt 21 is loaded via spring force in the direction toward opening 16 using a spring 22. Spring 22 is supported in the axial direction in locating bolt 21 which is designed as a hollow pin and against a disk 23 which is held in the axial direction in a cylindrical bore hole 25 in supporting flange 10 using a snap ring 24.

Supporting flange 10 and driven gear 5 bear against each other in the axial direction with two helical bevels L, L' which rise in the axial direction. Helical bevel L is shown in a perspective view in FIGS. 2 and 3. Mating surface L' of driven gear 5 is shown in FIG. 4. Bevels L, L' have a left-hand slope. In contrast, driven spindle thread 13 is designed as a right-hand thread, i.e., with a right-hand slope.

Figure 2:
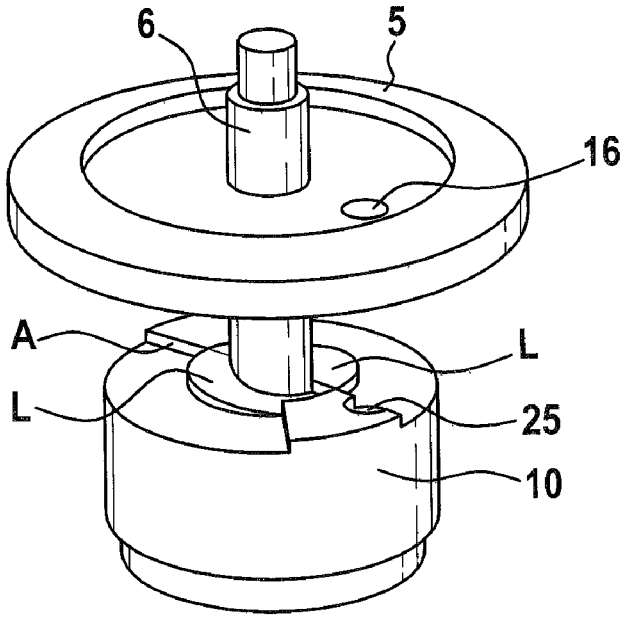
FIG. 2 is a perspective view of the clamping device with a supporting flange lifted away from the driven gear.
Figure 3:
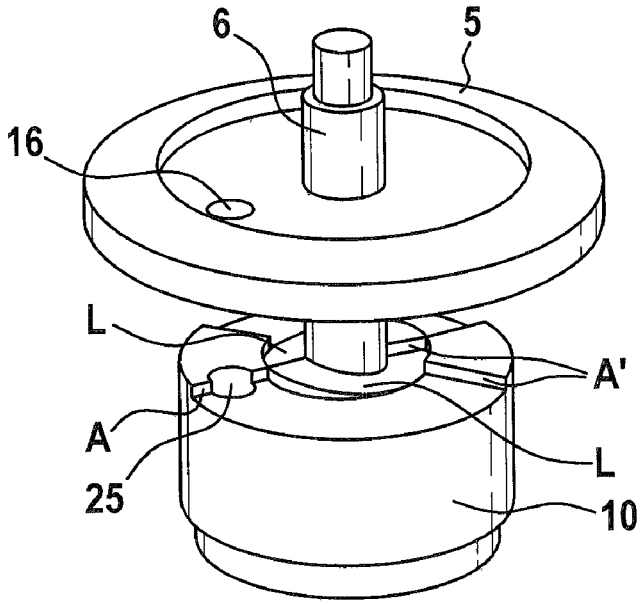
FIG. 3 is a view of the clamping device in FIG. 2 rotated by approximately 90° in the circumferential direction.
Figure 4:
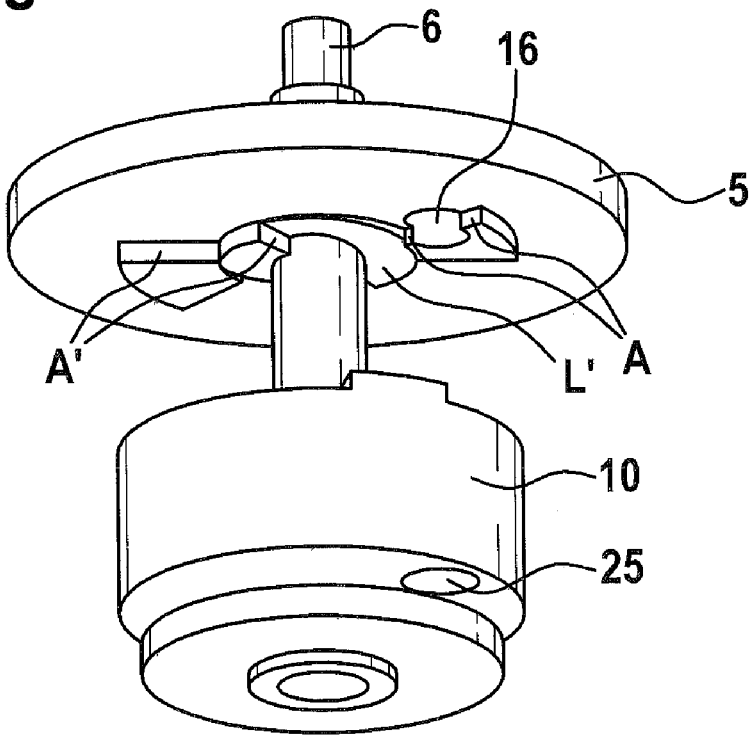
FIG. 4 is a perspective view of the clamping device in FIGS. 1 and 3, in a diagonal view from below.

As shown in FIGS. 2 through 4, stops A, A' which are located in the circumferential direction and are separated from each other are provided on the end face on driven gear 5 and on the end face on supporting flange 10. The distance between stops A and A' in the circumferential direction determines the angular range at the circumference within which supporting flange 10 can be rotated relative to working spindle 6. Torque from driven gear 5 is transferred to supporting flange 10 via stops A, A which can come to bear on both sides.

The mode of operation of the inventive clamping device is explained below: Locknut 14 is rotated manually in the counterclockwise direction relative to working spindle 6 and thereby bears axially against tool 15 which, as a result, is pressed against supporting flange 10 with increasing axial force. Supporting flange 10 bears via bevel L against bevel L' of driven gear 5 and against bearing 9 via driven gear 5. During the clamping procedure, snap-in bolt 18 is actuated using push button 17 and locks driven gear 5 and, therefore, working spindle 6 relative to housing 2. In this locked position, locating bolt 21 is not engaged with driven gear 5. Locating bolt 21 is located in a release position in which supporting flange 10 is displaced via bevel L in the circumferential direction and axially in the direction toward driven gear 5.

When locknut 14 is tightened, supporting flange 10 is driven by tool 15 in the clockwise direction—as viewed from the underside of the portable power tool—and rotates relative to working spindle 6, which causes supporting flange 10 to travel via bevel L along bevel L' of driven gear 5 and to be axially displaced in the direction toward tool 15, which, in turn, causes the clamping force on tool 15 to increase. Supporting flange 10 is rotated with its stop A against stop A of driven gear 5. In this position, cylindrical bore hole 25 with locating bolt 21 is aligned with opening 16. Locating bolt 21 is displaced by spring 22 into opening 16 and displaces snap-in bolt 18 out of opening 16 when push button 17 is released. As a result, clamping flange 10 is non-rotatably locked with driven gear 5. Movement in the axial direction away from tool 15 is therefore prevented.

For the case in which locknut 14 is tightened only slightly, and the two stops A therefore do not yet come to rest, the final clamping procedure takes place when drive 3 is started. Due to the moment of inertia of tool 15, clamping flange 10 is rotated via bevel L along bevel L' until stop A is reached. At this point, locating bolt 21 automatically snaps into opening 16.

Before locknut 14 can be released without the use of aids, locating bolt 21 must be guided out of opening 16. This takes place by actuating push button 17 and axially sliding snap-in bolt 18 into opening 16. When push button 17 is actuated, snap-in bolt 18 first comes in contact with the planar surface of driven gear 5 facing away from clamping flange 10. When tool 15 is rotated, snap-in bolt 18 is rotated in the direction toward the opening and it can snap into opening 16, thereby pushing locating bolt 21 out of it and releasing supporting flange 10. Since the lead angle of bevels L, L' is greater than the related friction angle, bevels L, L' are not self-locking. As a result, after locking mechanism 20 has been released, clamping flange 10 is automatically released via rotation axially in the direction toward driven gear 5. When tool 15 is rotated further in the direction of loosening/rotation of working spindle 6, clamping flange 10 travels along bevel L'. Locknut 14 can be easily loosened by hand.

It will be understood that each of the elements described above, or two or more together, may also find a useful application in other types of constructions differing from the types described above.

While the invention has been illustrated and described as embodied in a clamping fixture for detachably fastening a disk-shaped tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed as new and desired to be protected by Letters Patent is set forth in the appended claims.

The invention claimed is:

1. A clamping fixture for detachably fastening a disk-shaped tool on a rotatably driven working spindle with a driven gear which is non-rotatably connected with said working spindle, the clamping fixture comprising a fastening element; a supporting flange arranged so that the tool is accommodated between said fastening element and said supporting flange, said supporting flange being rotatably displaceable relative to the working spindle in the tightening direction and axially in a direction toward the tool, said supporting flange being rotatably displaceable relative to said working spindle in a release direction and axially away from the tool when said fastening element is released, said supporting flange being lockable with the driven gear in a position which is displaced axially in a direction of the tool, wherein said supporting flange cannot be displaced axially away from the tool until a lock is released, further comprising a locking mechanism, wherein said locking mechanism is configured to automatically lock said supporting flange when a specified axial position is reached, and wherein said locking mechanism includes at least one locating bolt which is spring-loaded in a direction of the driven gear and which, in a locking position, engages in an opening of the driven gear.

2. A clamping fixture as defined in claim 1, wherein the driven gear is provided with a driving element to transmit torque to said supporting flange given a specified relative position between said supporting flange and said working spindle.

3. A clamping fixture as defined in claim 2, wherein said driving element is configured to transmit torque to said supporting flange given a specified relative position between said supporting flange and said working spindle, when an axial deflection of said supporting flange is at a maximum.

4. A clamping fixture as defined claim 1, wherein said locking mechanism automatically locks said supporting flange when a maximum axial deflection of said supporting flange is reached.

5. A clamping fixture as defined in claim 1, wherein said locking mechanism is configured to automatically lock said supporting flange and is configured as a tooth system on an end face between said supporting flange and a driven gear.

6. A clamping fixture as defined in claim 1, wherein said locking mechanism is configured to automatically lock said supporting flange, and further comprising a spindle locking device configured to release said locking mechanism when being actuated.

7. A clamping fixture as defined in claim 1; and further comprising two axial bevels via which said supporting flange and a driven gear bear against each other.

8. A clamping fixture as defined in claim 7, wherein said two bevels have a lead angle which is greater than a friction angle between said supporting flange and said driven gear.

9. A clamping fixture as defined in claim 7, wherein said bevels have a left-hand slope, while said working spindle has a working spindle thread with a right-hand thread to fix said fastening element in place, said working spindle being driven in a clockwise direction as viewed in a driven direction.

* * * * *